United States Patent [19]

Young

[11] 4,064,999

[45] Dec. 27, 1977

[54] ADJUSTABLE BUILDING PANEL SCAFFOLD

[76] Inventor: Simon Young, P.O. Box No. 41, Mamou, La. 70554

[21] Appl. No.: 700,681

[22] Filed: July 7, 1976

[51] Int. Cl.[2] ..... E04F 21/18

[52] U.S. Cl. ..... 214/1 SW; 52/749; 182/141; 254/4 C

[58] Field of Search ..... 214/1 SW, 1 H, 1 S; 182/141; 254/4 R, 4 C; 52/126, 749, 632

[56] References Cited

U.S. PATENT DOCUMENTS

| | | | |
|---|---|---|---|
| 3,017,968 | 1/1962 | McMahon | 182/141 |
| 3,181,711 | 5/1965 | Stockton | 214/1 SW |
| 3,828,942 | 8/1974 | Young | 214/1 SW |

*Primary Examiner*—Trygve M. Blix
*Assistant Examiner*—George F. Abraham
*Attorney, Agent, or Firm*—James M. Pelton

[57] ABSTRACT

An elevatable and adjustable scaffold device for supporting ceiling or other panels usually attached to overhead rafters and ceiling beams, operable by one person and capable of fine adjustment for height, as well as length and width for working in small rooms.

1 Claim, 4 Drawing Figures

ADJUSTABLE BUILDING PANEL SCAFFOLD

BACKGROUND OF THE INVENTION

Prior art devices have been cumbersome, complicated, expensive and required more than one operator in order to effectuate a fine adjustment of the holding device.

BRIEF SUMMARY OF THE INVENTION

This invention comprises a novel and a useful adjustable lift scaffold for building panels and other materials and, more particularly, pertains to a mobile vertically adjustable platform to assist in elevating building panels and other materials into proper position to enable their application to an overhead portion of a building structure by a single operator.

The primary object of this invention is to provide an improved adjustable scaffold-type construction specifically adapted for use in aiding the worker in properly positioning ceiling panels or other building materials in readiness for their attachment to a building structure.

A specific objective of the invention is to provide a frame-like mobile scaffold construction consisting of a mobile base having a vertically telescoping and vertically adjustable carriage slidably mounted thereon which carriage is provided with suitable support surfaces for building panels or other materials which are difficult to handle by only one worker and to facilitate their positioning in different vertical elevations, as high as nine and one-half feet (9 ½) in readiness for their attachment to a building structure and the like.

A further and more specific object of the invention is to provide an adjustable scaffold in accordance with the preceding objects wherein improved means are provided to facilitate the elevation of the vertically movable carriage with its load thereon in a simple manner and with a minimum of exertion on the part of the worker.

Yet another object of the invention is to provide a device in accordance with the preceding objects wherein the carriage is compactly guided and telescopingly mounted within the frame work of the mobile base of the device whereby the framework of the carriage is not only guided by the framework of the base but serves to rigidify the latter.

A still further specific object of the invention is to provide an adjustable scaffold pursuant to the foregoing objects and having no bottom or side structure to hamper accessibility and freedom of movement of the operator's stepladder therethrough and underneath the under side of panels or other objects supported by the scaffold. Thus assuring a more upright position of the operator's stepladder and a more upright position with less exertion for the operator.

A final specific object of the invention to be enumerated herein is to provide a portable scaffold consisting of a movable base having a vertically adjustable carriage mounted upon said base with no side structure attached thereto, especially at the bottom. Having a mobile base with side structure attached thereto, especially at the bottom, denies proper positioning of the operator's stepladder causing the operator to take a sideways leaning position whereby access through the side structure from underneath the ceiling panels or other building materials supported by the scaffold requires extra exertion on the part of the operator and may cause a slip of the ladder, perhaps, resulting in serious injuries to the operator.

These, together with other objects and advantages which will become subsequently apparent, are provided by the present invention, the details of construction and operation of which are more fully hereinafter described.

DESCRIPTION OF THE DRAWINGS

Reference is made to the accompanying drawings, forming a part hereof, wherein like numerals refer to like parts throughout, and in which.

DETAILED DESCRIPTION OF PREFERRED EMBODIMENTS

Figure 1:
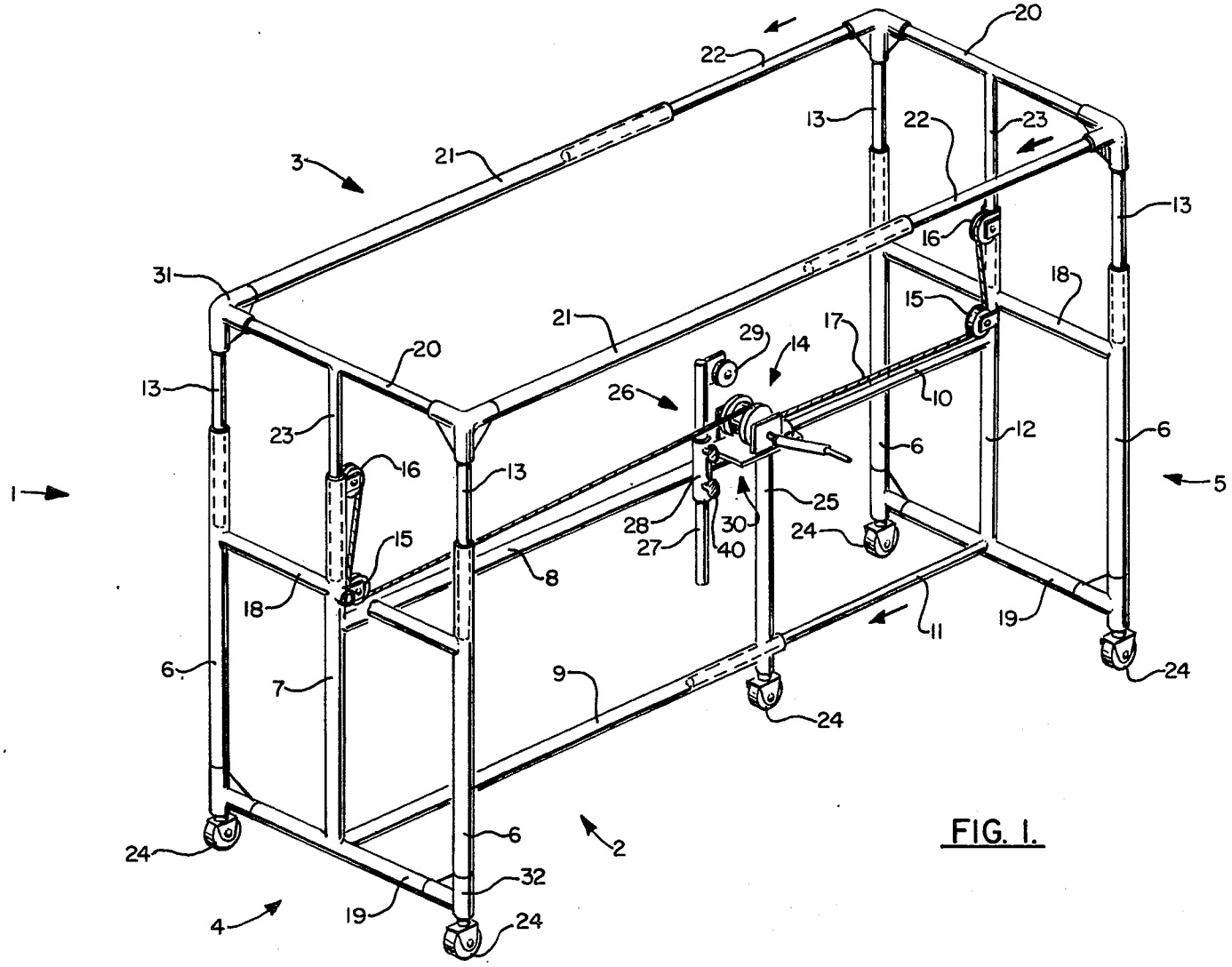
FIG. 1 is a perspective view of the adjustable building panel scaffold in accordance with this invention.

Referring first to FIG. 1, it will be seen that the adjustable panel lifting apparatus 1 includes a base unit 2 and a carriage unit 3. The base unit 2 has a first end unit 4 and a second end unit 5 both of which are of open frame work construction, for example, of galvanized pipe conventionally employed in the construction of scaffolding.

The base unit 2 has first end unit 4 formed by two hollow vertical leg members 6 and hollow central vertical leg 7 connected at their bottom by lower horizontal transverse brace 19 and adjacent the upper ends of said vertical legs 6 and 7 by upper horizontal transverse brace 18 by conventional means such as corner clamps, welding, threaded pipe connectors and the like. Central vertical leg 7 has connected at its lower end and normal to first end unit 4 hollow lower central horizontal longitudinal brace 9 and adjacent the upper end of central vertical leg 7, also normal to the plane of first end unit 4, upper hollow central horizontal longitudinal brace 8, both of which are connected at the distal ends from first end unit 4 by upper and lower central hollow horizontal longitudinal brace connector leg 25.

Similarly, second end unit 5 has two hollow vertical legs 6 and hollow central vertical leg 12 connected by upper and lower horizontal transverse braces 18 and 19, respectively, forming a generally rectangular open framework. Solid upper central horizontal longitudinal brace 10 is connected at one end adjacent the upper end of hollow central vertical leg 12 and has its distal end inserted into the said brace 8. Likewise, solid lower central horizontal longitudinal brace 11 is connected at one end adjacent the lower end of hollow central vertical leg 12 and has its distal end inserted into the said brace 9. Thus, the first end unit 4 and the second end unit 5 are slidably and telescopingly engaged and the length of base unit 2 can be adjustable to fit the panels and rooms in which it is used. Although not depicted in FIG. 1, it can be readily envisioned by the skilled worker that in a similar manner vertical legs 6 can be made slidably adjustable so that base unit 2 can be also made wider or narrower to fit panels or rooms with which the invention may be used.

As further seen in FIG. 1, carriage unit 3 is of generally open framework construction in a rectangular form and located in a plane normal to the vertical. Hollow longitudinal horizontal carriage unit support members 21 are connected at one end by transverse carriage unit horizontal support member 20. At their distal ends said support members 21 have slidably inserted therein solid longitudinal horizontal carriage unit support members 22 which are connected by transverse carriage unit horizontal support member 20. Thus, the said members 20, 21 and 22 form the rectangular open framework upon which a ceiling panel or other building material is rested and held in place before, during and while attaching the panel to the ceiling rafters or other building structure. This composite framework is guided by solid vertical legs 13 at each corner of the carriage unit 3 and end units 4 and 5, respectively, being in slidable and telescoping engagement within hollow vertical legs 6 of base unit 2. The carriage unit is lifted into position by central downwardly extending legs 23 located at substantially the center of transverse horizontal support members 20 and extending in slidable telescoping relation into or out of hollow central vertical legs 7 and 12 of said first and said second end units 4 and 5, respectively. The corners of carriage unit 3 can be connected by any conventional means such as by welding, threaded pipe connections, or by corner brackets 31, as shown in FIG. 1.

The lifting of carriage unit 3 is accomplished by actuating means 14. Actuating means 14 includes double acting winch means 30 located about midway between said first and said second end units 4 and 5 on upper central hollow longitudinal horizontal brace 8, cable slack take up means 26 which also includes adjustable cable slack take up post 27, having at its upper end pulley 29 and being slidably adjustable in bracket 28 which can be tightened by adjusting wing units 40. Winch means 30 has attached thereto cables 17 of substantially equal length which run under lower base unit pulleys 15, located adjacent the connection of brace 8 and central vertical leg 7 in said first end unit 4 and adjacent the connection of brace 10 and central vertical leg 12 in said second end unit 5, and over upper base unit pulleys 16, located, respectively, at the upper ends of central vertical legs 7 and 12, and are attached to carriage unit 3 at the bottom of downwardly extending legs 23. Thus, the actuating means 14 can be used to raise or lower carriage unit 3 by operation of winch means 30 to wrap or unwrap cables 17 which acting over said pulleys 15 and 16 shorten or lenghthen the cable attached to downwardly extending legs 23. Winch means 30 can be any conventional double acting winch equipped with a gearlock, having for easy manual operation and smooth lifting or lowering, a gear ratio of at least 3 to 1. The winch should lock at any height and have a lifting capacity of at least about 700 pounds.

Figure 2:
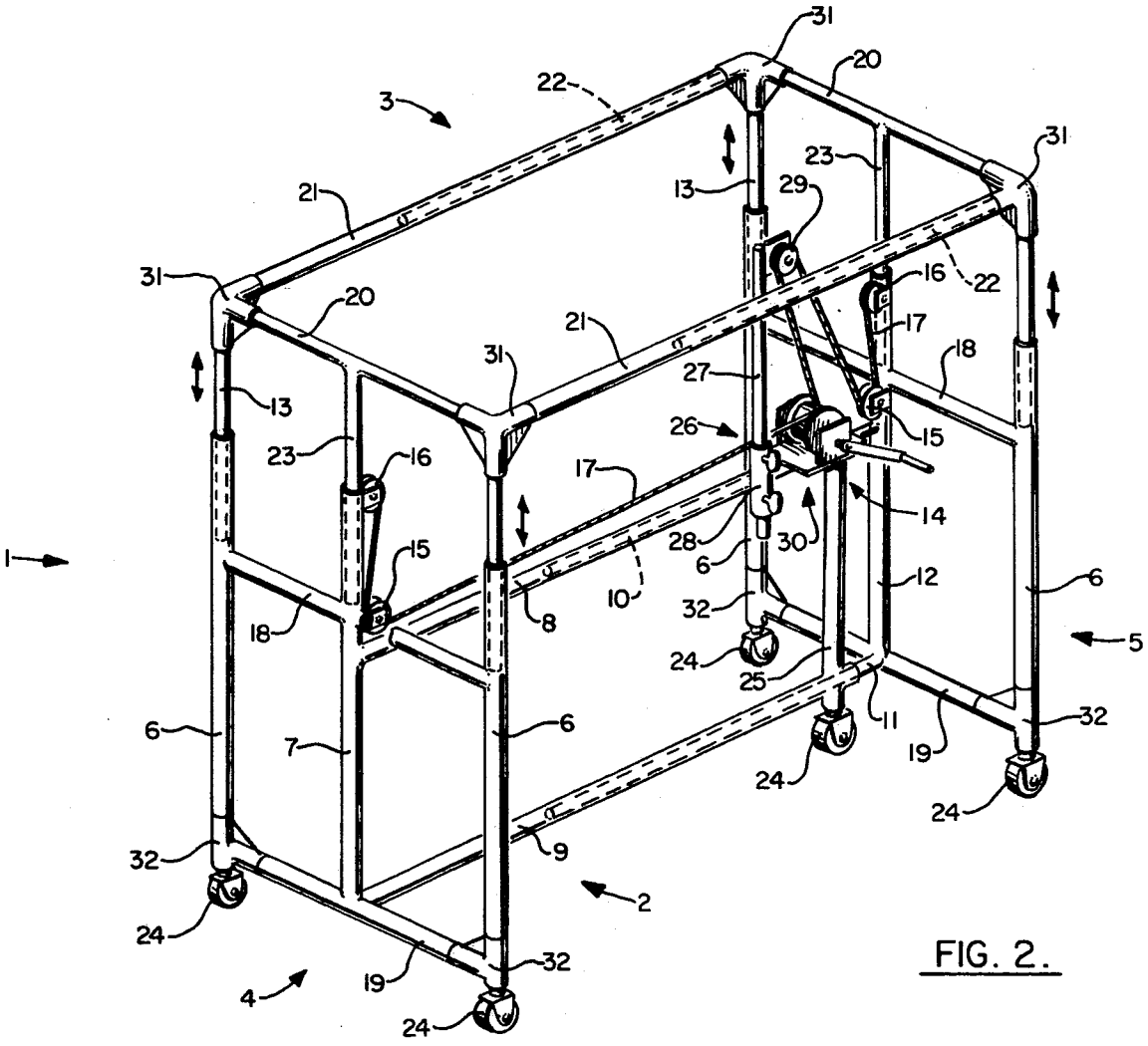
FIG. 2 is a perspective view of the adjustable building panel scaffold in readiness to be used in smaller rooms such as bathrooms.

Referring to FIG. 2, it can be easily seen that the portable panel lift apparatus 1 is similar to that of FIG. 1, except that it is longitudinally compressed or adjusted for use and operation in a small room. In such configuration, the cables 17 have unequal distances to travel. To lengthen the path of cable 17 to said second end unit 5 cable slack take-up means 26 is employed. Depending on how much slack is put in cable 17 because of the shortened distance to said second end unit, cable 17 is threaded over pulley 29 and post 27 is adjusted in height by wing nuts 40 in bracket 28 to take out the slack in cable 17, all of this being done while carriage unit 3 is unloaded and in lowered position. Thus, the same length path will always be traveled by cable 17 and the lift on carriage unit 3 will be equal on each end.

Figure 3:
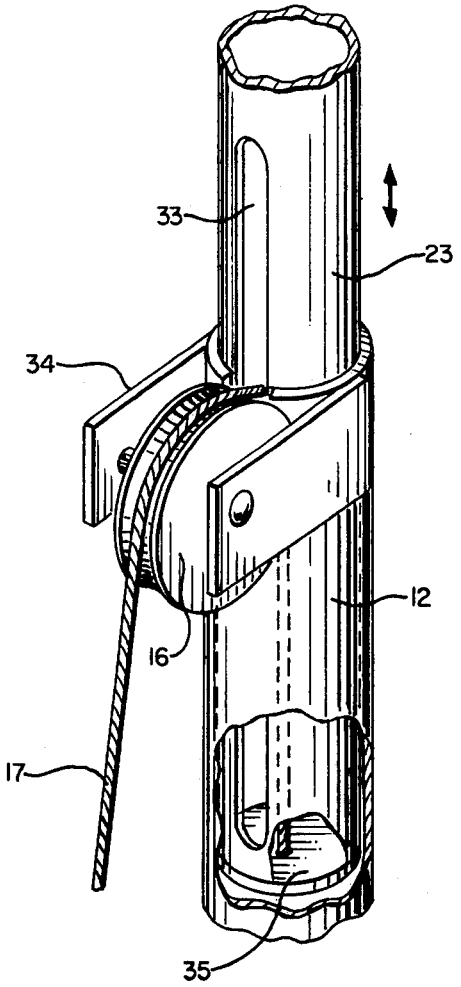
FIG. 3 is a fragmentary view of the telescoping and lifting mechanism.

In FIG. 3, there is shown, as a specific embodiment, one means of attachment of cable 17 to downwardly extending leg 23 and operation of slidable relation between said downwardly extending leg 23 and central vertical leg 12, for example. As shown, the end 35 of leg 23 has the end of cable 17 welded thereto for greater safety. Although this method is shown, one could also employ hook-and-eye bolts, attachment by knotting cable 17 through a hole in the end 35 or other conventional means. The cable 17 passes through slot 33 in downwardly extending leg 23, over pulley 16, held by pulley bracket 34 and so forth back to winch means 30 as more particularly described in FIG. 1.

Figure 4:
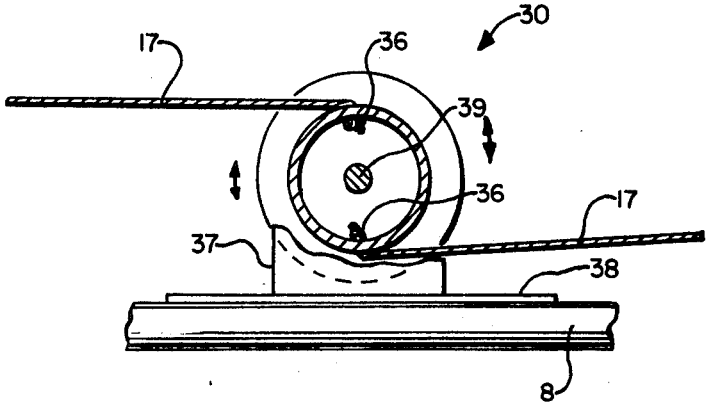
FIG. 4 is a partially cutaway view of the winch means.

Winch means 30 is shown in cutaway detail in FIG. 4 to primarily illustrate the attachment of cable 17 to the drum of winch means 30. Winch means 30 is held to the apparatus 1 by base plate 38 welded or otherwise conventionally attached to upper central hollow horizontal longitudinal brace 8. Baseplate 38 has winch bracket 37 attached thereto and central axis 39 of winch 30 is also located therein. The gears, lock and handle are conventional and well within the skill of the art. Cable 17 is attached to winch drum at points 180° apart so that turning winch 30 balances the opposing weight of the carriage unit 3 and the load.

In order to impart mobility to the structure, the base unit has provided castor wheel units 24. As thus far described, it will be apparent that building panels such as 4 × 8 masonite, plywood, plaster boards, sheetrock and other ceiling panels or other building material may be rested upon the top of the carriage unit 3 and may be manually adjusted by operating double acting winch means 30. Thus, a ceiling panel may be held against a ceiling for attachment thereto by the worker. Further, this adjustable scaffold may be utilized for various other purposes for vertically positioning different building materials of much greater areas or sizes than have been previously mentioned. For this purpose, it was firmly constructed of strong durable, lasting and rustproof galvanized steel pipes. It will be appreciated that a worker can, by virtue of the open top construction of the carriage unit 3 and open construction of the bottom of the base unit 2, obtain access to the underside of any building material, without having to assume a leaning sideways and uncomfortable and dangerous position when it is desired to secure the material against overhead structures.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the lawful scope of the invention described in the appended claims.

What is claimed as new is as follows:

1. A panel lifting apparatus for raising and hold ceiling panels in place during attachment thereof to ceiling joists including:

a. a base unit having first and second generally rectangular end units each consisting of three hollow vertical leg members connected at their lower ends and adjacent their upper ends by an upper and lower transverse horizontal brace, said first end unit connected to said second end unit longitudinally by an upper and lower central hollow horizontal brace member, said upper central hollow horizontal brace member being connected adjacent the upper end of the central vertical leg on said first end unit and said lower central horizontal brace member being connected at one end at the bottom of the central vertical leg of said first end unit and having inserted in the opposite ends of said upper and lower central hollow horizontal brace members, one end of each of an upper and lower solid central horizontal brace member, respectively, and having the opposite end of each of said upper and lower solid central horizontal brace members being connected, respectively, adjacent the upper end of the central vertical leg of said second end unit and to the bottom of said central vertical leg of said second end unit so that said base unit is slidably adjustable longitudinally;

b. a carriage unit of a generally rectangular frame registerable over said first and second end units in a horizontal plane normal to the vertical above said first and second end units and said carriage unit being slidably adjustable longitudinally in the same manner as the basement and being slidably connected to said base unit by downwardly extending solid vertical legs, each of which is slidably engaged in a vertical leg of said base unit; and c. actuating means located on said upper central hollow horizontal brace member including a cable attached to the lower end of each central downwardly extending vertical leg from said carriage unit and attached over a suitable arrangement of pulleys to winch means whereby on operation of the actuating means, said carriage unit is raised or lowered vertically as desired.

* * * * *

UNITED STATES PATENT OFFICE

CERTIFICATE OF CORRECTION

PATENT NO. : 4,064,999

DATED : December 27, 1977

INVENTOR(S) : Simon Young

It is certified that error appears in the above-identified patent and that said Letters Patent are hereby corrected as shown below:

Column 6, line 6, "basement" should read -- base unit --.

Signed and Sealed this

*First* Day of *August 1978*

[SEAL]

*Attest:*

RUTH C. MASON
*Attesting Officer*

DONALD W. BANNER
*Commissioner of Patents and Trademarks*